US007047918B1

(12) United States Patent
Polimeni, Jr.

(10) Patent No.: US 7,047,918 B1
(45) Date of Patent: May 23, 2006

(54) REED VALVE FOR AN INTERNAL COMBUSTION ENGINE

(76) Inventor: Ralph F. Polimeni, Jr., 15205 Bailey Canyon Ct., Reno, NV (US) 89511

( * ) Notice: Subject to any disclaimer, the term of this patent is extended or adjusted under 35 U.S.C. 154(b) by 0 days.

(21) Appl. No.: 11/074,259

(22) Filed: Mar. 7, 2005

(51) Int. Cl.
*F02B 33/04* (2006.01)

(52) U.S. Cl. ..... 123/73 V; 137/855

(58) Field of Classification Search ..... 123/73 V; 137/855–857
See application file for complete search history.

(56) References Cited

U.S. PATENT DOCUMENTS 5,103,867 A 4/1992 Wu
5,143,027 A 9/1992 Bergeron
5,245,956 A 9/1993 Martin
5,253,617 A 10/1993 Fitzpatrick
5,370,088 A 12/1994 Nakamura
5,390,699 A 2/1995 Yamada
5,421,368 A 6/1995 Maalouf
5,655,898 A 8/1997 Hashimoto
5,794,654 A 8/1998 Marvonek
5,937,834 A 8/1999 Oto
6,615,774 B1 9/2003 Heulitt

*Primary Examiner*—Noah P. Kamen
(74) *Attorney, Agent, or Firm*—William H. Eilberg

(57) ABSTRACT

A reed valve for an internal combustion engine has petals which are curved, such that each petal has a concave surface that faces a concave surface of another petal. The curvature of the petals makes the petals more responsive to changes in pressure, thus enabling the valve to begin to open or close more rapidly. The petals preferably have a permanent curvature, and may also be tapered, so that their thickness is least at their distal ends. The reed valve made with the petals described above enhances the performance of internal combustion engines.

16 Claims, 7 Drawing Sheets

REED VALVE FOR AN INTERNAL COMBUSTION ENGINE

BACKGROUND OF THE INVENTION

This invention relates to the field of internal combustion engines, and provides a reed valve for controlling the flow of fluids into the combustion chamber of such engines.

Reed valves have been used in internal combustion engines, to control the flow of air, or of fuel-air mixtures, into the combustion chamber of the engine. A reed valve is essentially a check valve, permitting the flow of fluid into the engine, and effectively sealing the crankcase against back flow. Reed valves are most commonly used in two-stroke internal combustion engines, but have also been employed in four-stroke engines.

Reed valves have been shown to increase engine efficiency, especially at low speeds, by reducing "blow back" of gases into the intake system. Use of the reed valve reduces rough idling, and enables the engine to produce more power.

A reed valve typically includes a plurality of petals that open and close, relative to each other, in response to fluid flows and pressures. When open, the petals define a path for fluid to flow into the engine. When closed, the petals prevent fluid from flowing back towards the intake side.

An inherent disadvantage of a reed valve is that, like any valve, it creates a pressure drop, as the fluid must do work to open the valve. At high engine speeds, this pressure drop can become substantial. Therefore, it is desirable that the reed valve present as little resistance as possible to the incoming fluid stream.

The present invention provides a reed valve having an improved construction, such that the valve is much more sensitive to fluid flows and pressures, as compared with reed valves of the prior art. The reed valve of the present invention creates a lower pressure drop, as compared with prior art valves, and thus improves the efficiency of engine operation.

SUMMARY OF THE INVENTION

The present invention comprises a reed valve for an internal combustion engine. The reed valve has a plurality of curved petals, each petal having a proximal end affixed to a housing, and a distal end which is free. The petals define an open and a closed position. In the closed position, the distal ends of the petals are in proximity with each other. In the open position, the petals spread apart. Each petal has a curvature, such that each petal defines a concave surface which faces another concave surface of another petal.

The petals of the reed valve preferably have a permanent curvature, so that the petals, if laid on a table, would not lie flat. The petals are preferably made of a fibrous composite material, but also may be made of metal or some other material.

In a preferred embodiment, the petals are pre-stressed so that each petal is at least partially biased in the closed position.

In another preferred embodiment, each petal has a thickness which tapers continuously from an area of greater thickness, near the proximal end, to an area of reduced thickness, at or near the distal end. Making the petal thinner at the distal end makes the petal more responsive to changes in pressure, and results in improved valve performance.

The present invention therefore has the primary object of providing an improved reed valve for use in an internal combustion engine.

The invention has the further object of improving the efficiency of a reed valve, by providing a valve structure which is more responsive to changes in pressure than comparable valves of the prior art.

The invention has the further object of improving the performance and efficiency of an internal combustion engine.

The reader skilled in the art will recognize other objects and advantages of the present invention, from a reading of the following brief description of the drawings, the detailed description of the invention, and the appended claims.

DETAILED DESCRIPTION OF THE INVENTION

Figure 1:
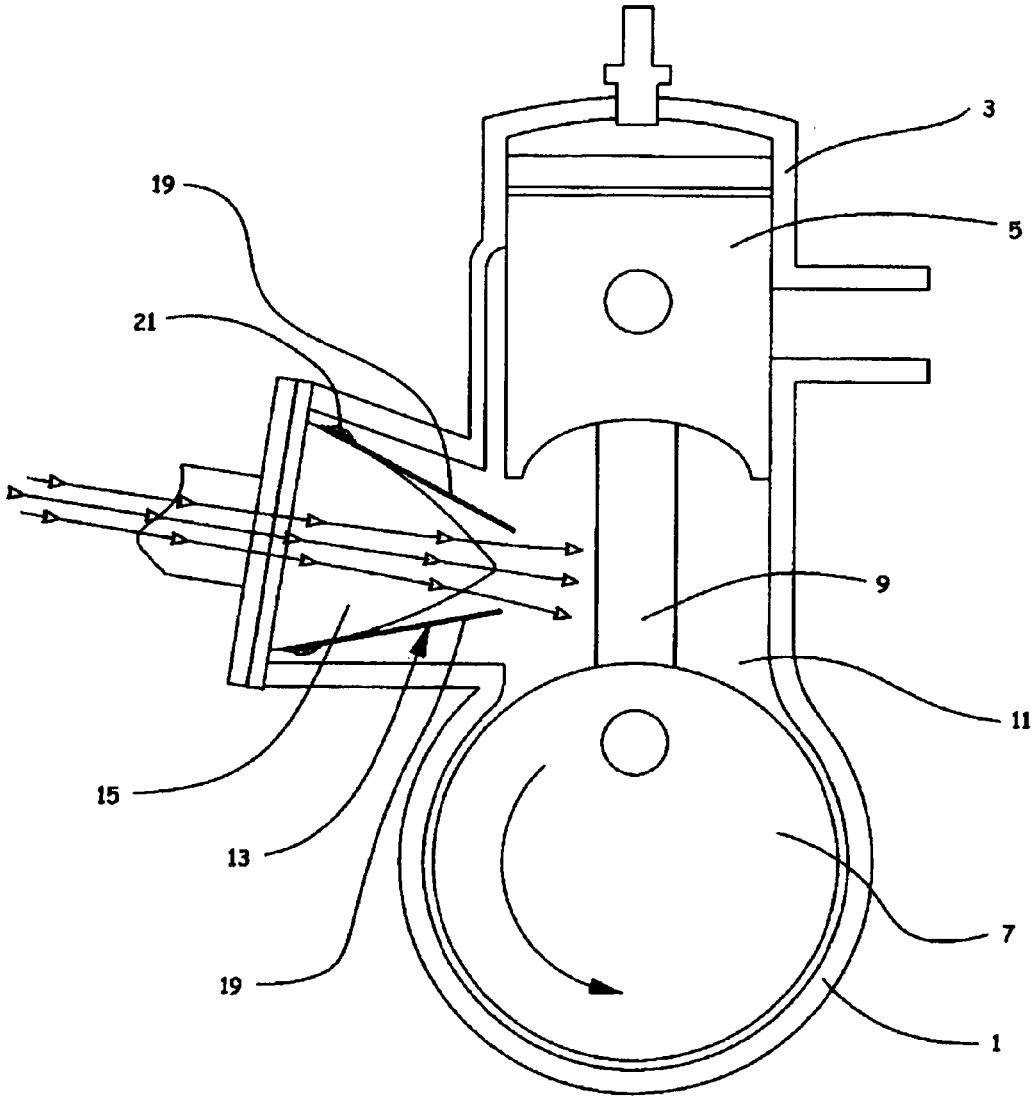
FIG. 1 provides a cross-sectional view of a portion of an internal combustion engine, having the reed valve of the present invention, the drawing showing the piston near the top of the cylinder, and the reed valve in the opened condition.
Figure 2:
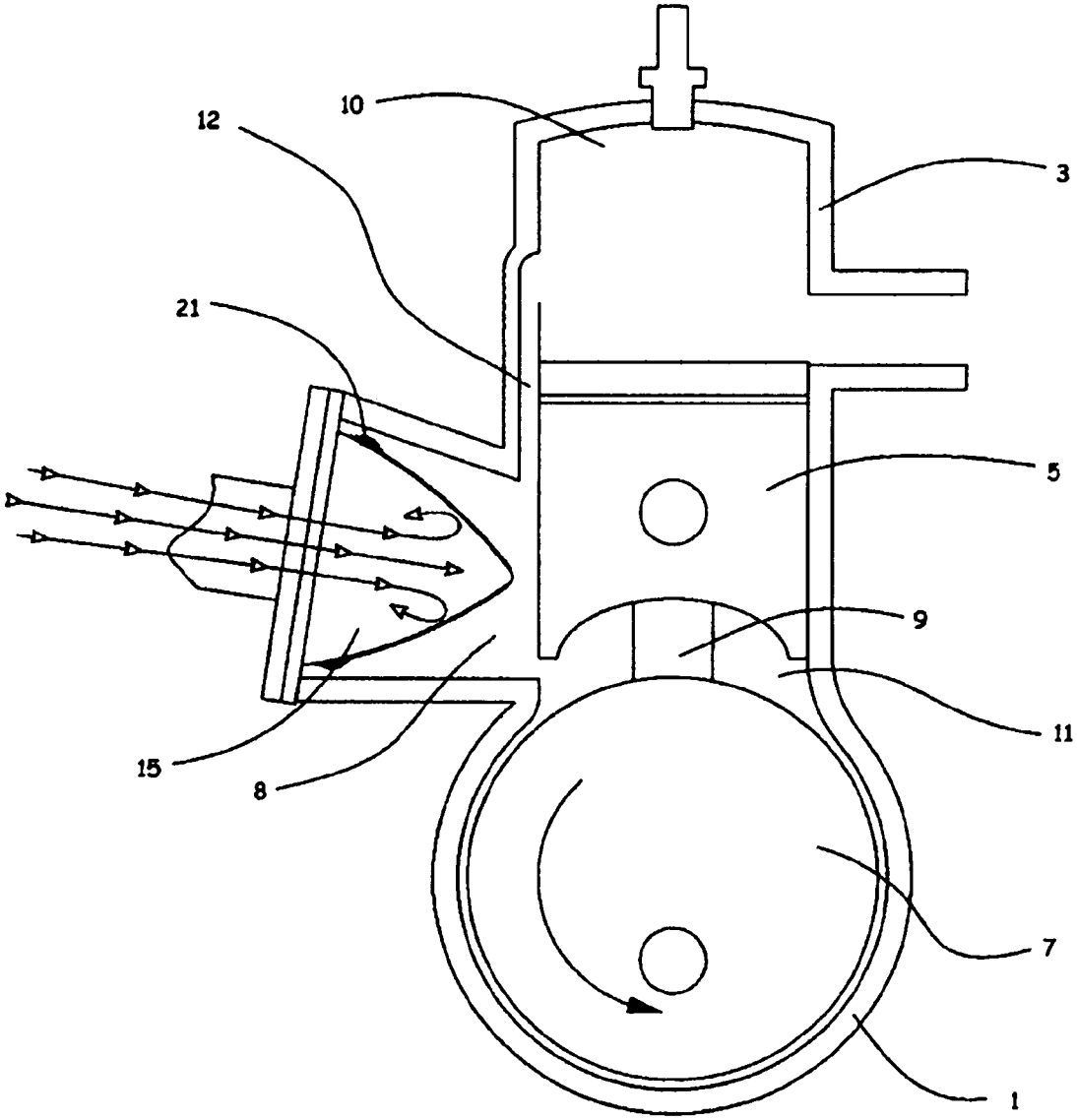
FIG. 2 provides a drawing similar to FIG. 2, except that the piston is near the bottom of the cylinder, and the reed valve is in the closed condition.

FIGS. 1 and 2 show diagrams of a portion of an internal combustion engine, including the reed valve of the present invention. These figures depict a two-stroke engine, as reed valves are typically used with such engines. However, the invention is not necessarily limited to use with a two-stroke engine.

The engine includes a crankcase 1 which houses cylinder 3. Piston 5 reciprocates within the cylinder, and transmits motion to crankshaft 7 through connecting rod 9, thereby converting linear motion to rotary motion. In FIG. 1, the piston is near the top of the cylinder, and in FIG. 2, the piston is near the bottom of the cylinder.

Reed valve 13 is connected to the crankcase, so as to allow fluid, under certain conditions, to enter the interior of the crankcase. The fluid is typically air or an air-fuel mixture, flowing from a carburetor (not shown). The reed valve includes a reed block 15, and a plurality of petals 19. The reed block and petals together comprise the reed valve. In the embodiment shown, there are two petals, but the valve could be modified to employ more than two petals. What is necessary is that when the petals are drawn together, they together form at least a partial seal which prevents or inhibits fluid from flowing back towards the carburetor.

Each petal has a proximal end, at which the petal is attached to the reed block 15, such as by screws 21. The other end of each petal is free; the free end is designated as the distal end.

The reciprocating motion of the piston causes high and low pressure conditions within the crankcase. In particular, as the piston moves towards the top of the cylinder, as shown in FIG. 1, a region of lowered pressure is created in region 11 of the crankcase. This low pressure region causes the reed valve to open, as shown in FIG. 1. Due to the lowered pressure within the crankcase, and the relatively high pressure upstream (i.e. on the left-hand side in FIG. 1), the petals 19 of the reed valve open, allowing fluid (represented by the arrows) to enter the interior of the crankcase.

Conversely, when the piston moves towards the bottom of the cylinder, as shown in FIG. 2, the pressure in region 11 of the crankcase becomes higher than the pressure upstream, and this condition causes the petals to close. When the petals are closed, fluid from the carburetor (or other external component) is largely prevented from passing through the valve, and little or no fluid from inside the crankcase passes through the valve. The valve momentarily seals the interior of the crankcase from the exterior.

It should be noted that, in the preferred embodiment, the distal ends of the petals do not touch, even in the closed position. Instead, it is preferred that, in the closed position, the distal ends of the petals nearly touch each other. By "nearly" touching, it is meant that the distal ends of the petals are close enough to provide a reasonable seal, but not a perfect, fluid-impervious seal, against back flow. Thus, the petals prevent most, but not all, of the fluid from exiting the crankcase. In operation, the petals will open and close very rapidly, so a perfect seal is not required. Moreover, if the distal ends of the petals touch each other, they may influence each other's movements in an undesirable manner, when the petals are fluttering rapidly between open and closed positions.

Although it is preferred that the distal ends of the petals never touch, it is still possible to practice the invention in a manner wherein the distal ends do touch. The invention is intended to cover both alternatives.

An essential element of the present invention is that the petals of the reed valve are curved. The curvature is especially apparent in FIG. 2, where the petals are shown in the closed position. By "curved", it is meant that the petals are curved in their natural state; the curvature is permanent. If one were to lay a petal on a flat, horizontal surface, without applying any forces to the petal, the petal would not lie flat, because the curvature is an inherent characteristic of the petal. The petals used in reed valves of the prior art have varying degrees of curvature, but they curve only when pressure is applied, and are not curved in their natural states.

The petals are oriented such that the concave surface of each petal faces the concave surface(s) of the other petal(s). This feature is apparent, for example, in FIG. 2, which shows the valve in the closed position. With the valve in this closed position, the incoming fluid stream (flowing from left to right in FIGS. 1 and 2) encounters the concave surfaces of the petals. Conversely, if fluid within the crankcase were to attempt to flow out of the crankcase, i.e. from right to left in FIG. 2, the fluid would encounter the convex surfaces of the closed petals.

Figure 3:
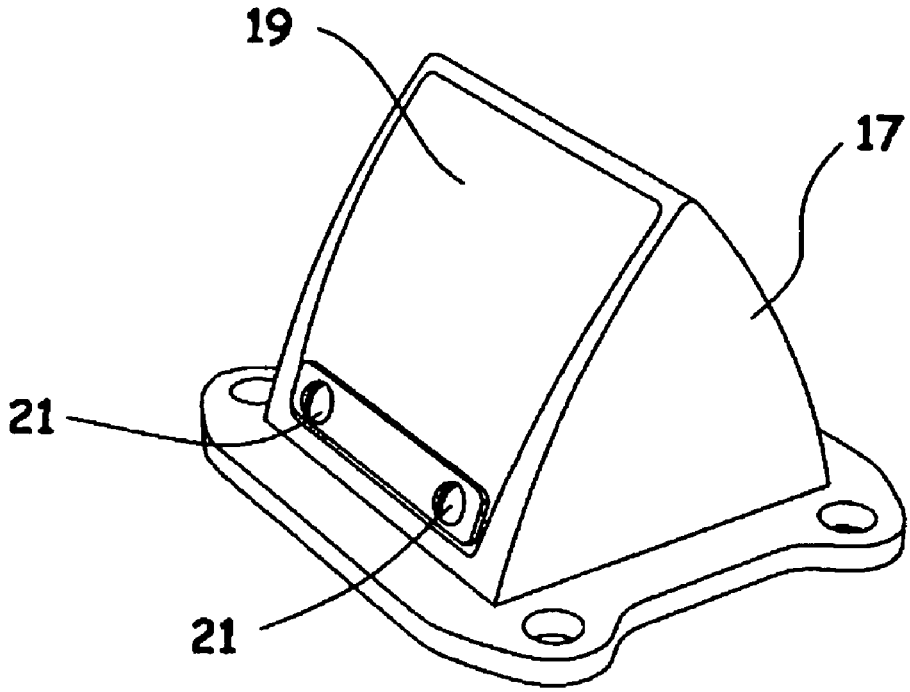
FIG. 3 provides a perspective view of the reed valve used in the present invention.
Figure 3A:
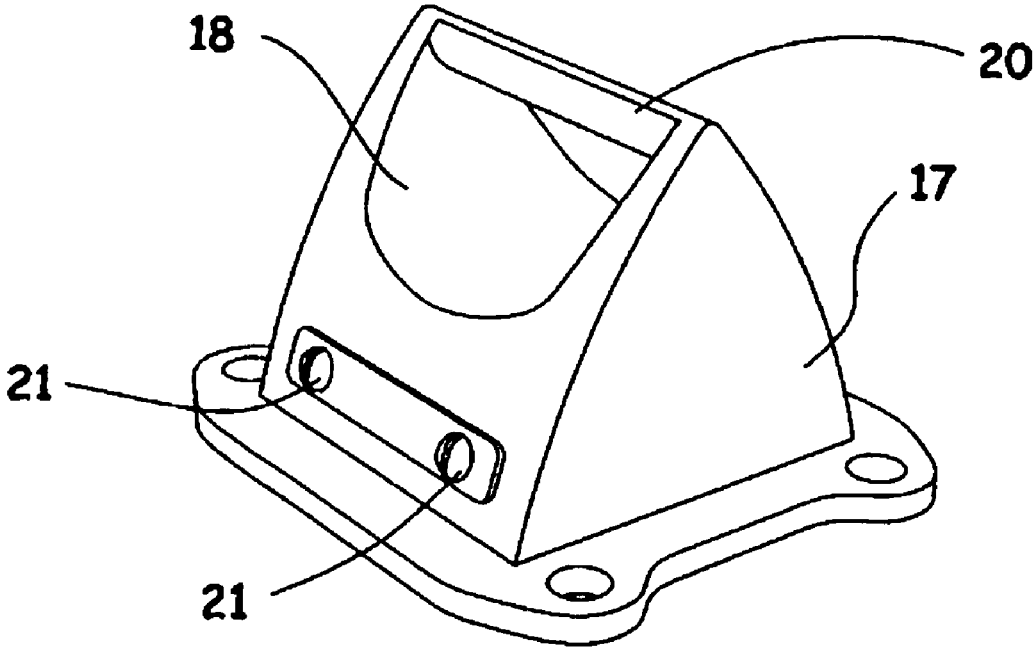
FIG. 3A provides a perspective view of a reed block, forming a part of the reed valve, used in the present invention.
Figure 4:
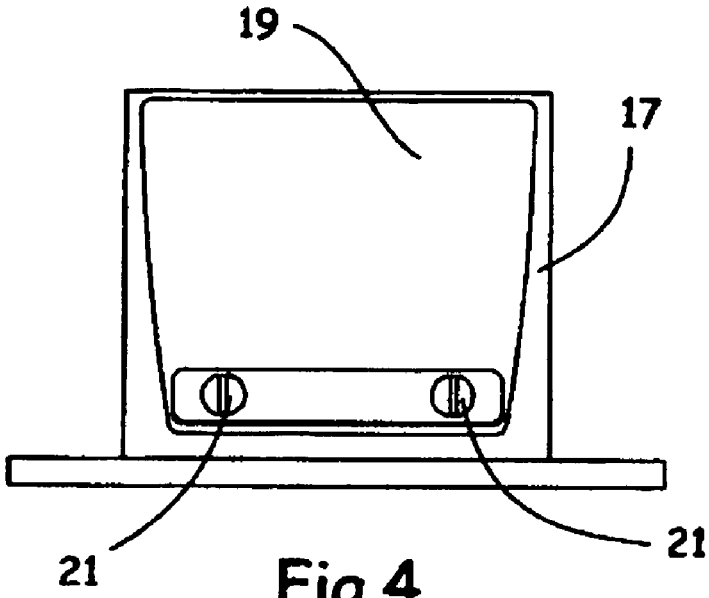
FIG. 4 provides a front elevational view of the reed valve of FIG. 3.
Figure 5:
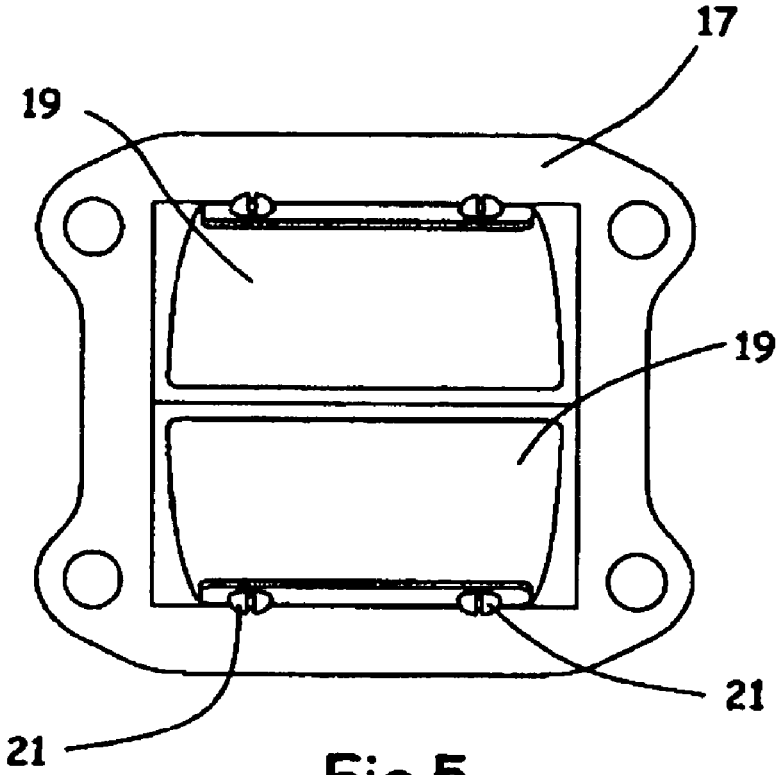
FIG. 5 provides a top view of the reed valve of FIG. 3.

FIGS. 3–5 illustrate the reed valve in more detail. As noted above, the reed valve includes a reed block and a plurality of petals. The reed block includes a generally hollow frame 17 which holds petals 19 by screws 21. The frame is shaped to conform generally to the curved shape of the petals, as is apparent in FIGS. 3 and 3A. The curved surfaces defined by the reed block are also shown explicitly in FIGS. 1 and 2, the petals being located outside these surfaces.

The difference between FIG. 3 and FIG. 3A is that FIG. 3 shows the reed block with the petals 19 attached (only one petal being visible in the view of FIG. 3), while FIG. 3A shows the reed block without the petals. FIG. 3A explicitly illustrates the hollow interior of the frame 17, and shows the large cut-out portion 18 which is exposed when the petals are removed. Cross-piece 20 is located at the apex of the frame, and provides a seat for the distal ends of the petals, when they are installed. The cross-piece may also assist in forming a partial seal, together with the petals. That is, when the petals are in the closed position, they rest against the cross-piece, and the valve becomes momentarily closed, even though the distal ends of the petals do not touch.

FIG. 4 provides a front elevational view of the reed block with the petals attached, and FIG. 5 provides a top view.

The petals can be made of composite fibers, or of metal, or of other suitable materials.

Figure 8:
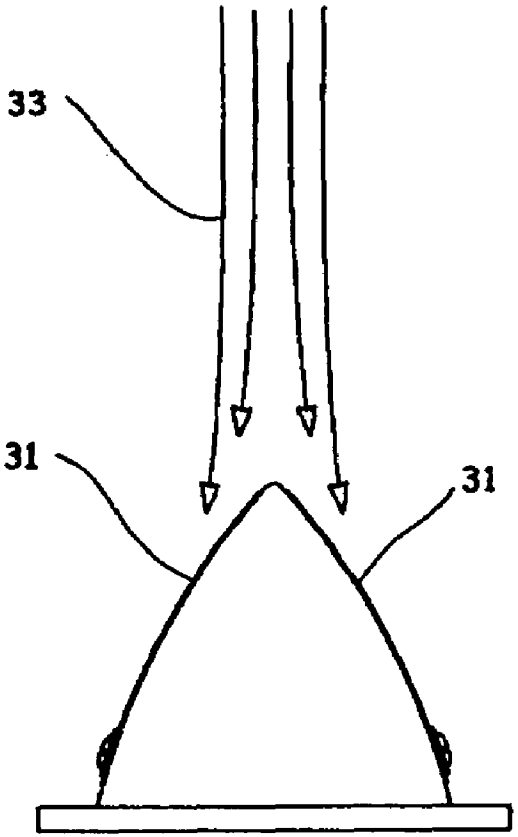
FIGS. 6–8 provide schematic diagrams showing the positions of the petals of the reed valve of the present invention, under various conditions of fluid pressure.
Figure 7:
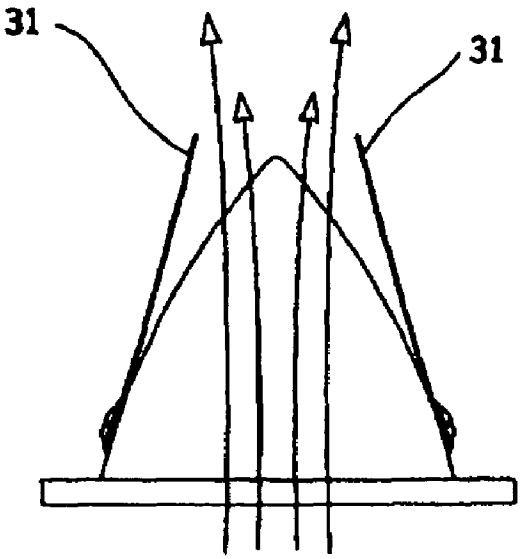
Figure 6:
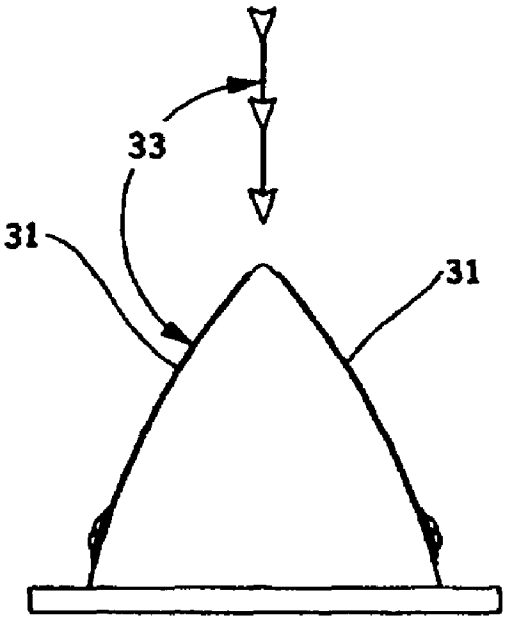
Figure 11:
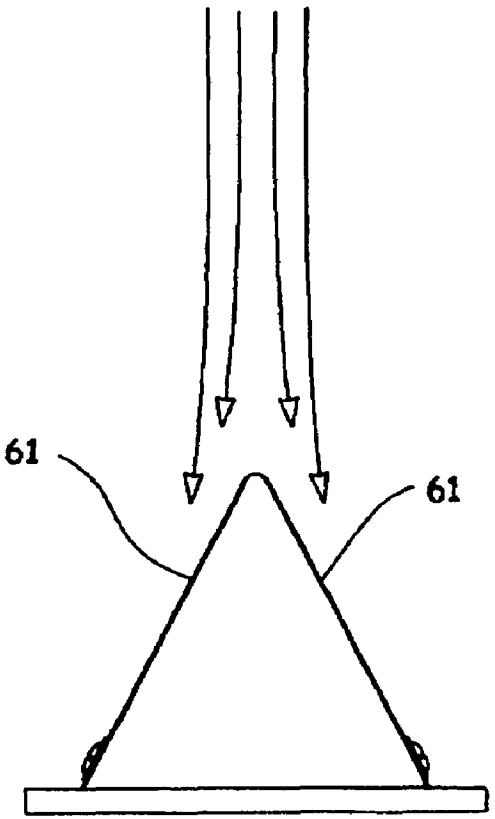
Fig.11 Prior Art
FIGS. 9–11 provide schematic diagrams similar to FIGS. 6–8, showing comparable positions of the petals of a reed valve of the prior art.
Figure 9:
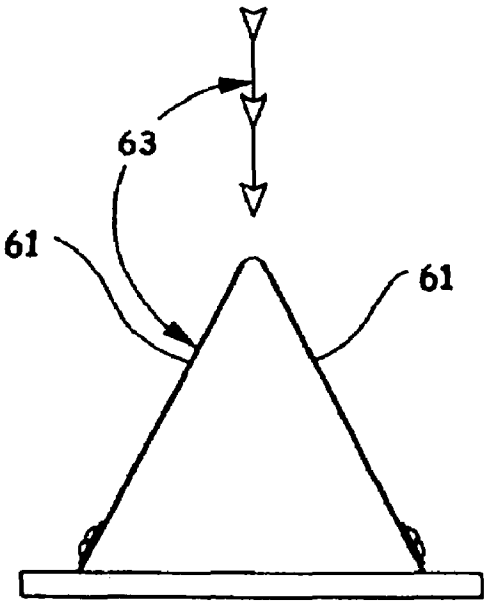
Fig.9 Prior Art

The operation of the reed valve of the present invention can best be described with reference to FIGS. 6–8, and in comparison with FIGS. 9–11, which show comparable positions of a reed valve of the prior art. FIGS. 6–8.

In particular, FIG. 6 illustrates a reed valve of the present invention, with the reed petals 31 in the closed position. FIG. 9 similarly shows a reed valve of the prior art, in which the petals 61 are flat and not curved. In comparing FIGS. 6 and 9, it is apparent that the angle 33, between an incoming fluid stream and a surface of the petal, is different from the corresponding angle 63 in FIG. 9, where the petal is flat. In particular, the angle 33 is somewhat smaller (less obtuse) than the corresponding angle 63, because of the curvature of the petal.

The effect of the curvature is that the surface of the petal is slightly closer to being perpendicular to the flow of fluid, than is the case in the prior art. This shape makes the petals 31 begin to open sooner, in response to fluid pressure, as compared to the case of petals 61 of the prior art.

Figure 10:
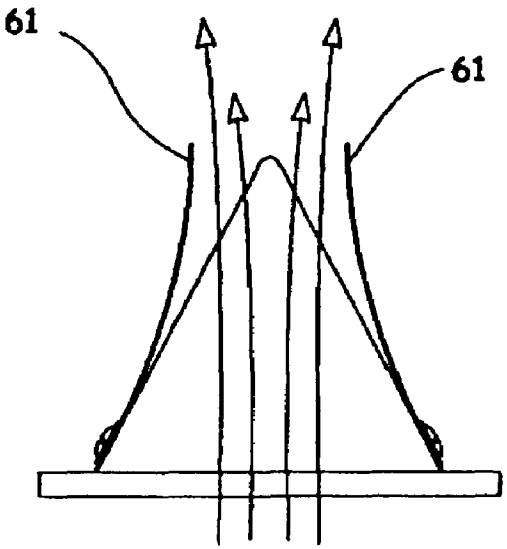
Fig.10 Prior Art

FIG. 7 illustrates the opening of the petals of the reed valve of the present invention, and FIG. 10 shows a comparable condition in a reed valve of the prior art.

The curved shape of the petals of the present invention also assists in closing of the valve, as well as in opening it. FIG. 8 shows the closing of the petals 31, under the influence of back flow indicated by arrows 33. Because the angle presented by the surfaces of the petals is slightly closer to being perpendicular to the flow, than is the case in FIG. 11, the petals 31 close earlier than would occur with the prior art valve.

The earlier the petals begin to open, in FIG. 7, the more fluid can pass through the reed valve assembly and into the crankcase. The sooner the curved petals begin to close, in FIG. 8, the more the fluid tends to stay in the crankcase, where it travels through transfer port 12, of FIG. 2, to combustion chamber 10, resulting in greater power.

The curved petals also provide the advantage of defining a greater volume on the upstream side of the valve. That is, since the concave surfaces of the petals face the incoming fluid stream (as shown in FIGS. 1 and 2), there is more volume of incoming fluid that is momentarily held by the petals when the petals are closed. This increased volume of fluid acts as a reservoir, storing a larger amount of fluid which is ready to flow into the crankcase when the reed petals open. The existence of a larger reservoir reduces the pulsing of the fluid flowing to the reed valve. The result is a more constant and efficient flow of fluid.

Also, due to the increased volume of fluid held by the reed petals, the fluid, when it passes through the valve, displaces a greater volume in the cylinder plenum 8. This displacement of volume decreases the effective volume of the crankcase. As the piston travels downward, the fluid in the crankcase is contained within an effectively smaller volume, causing more fluid to enter the combustion chamber 10, further resulting in greater power.

The petals need not be of uniform thickness throughout. In a preferred construction, illustrated in the perspective view of FIG. 12, the petal 72 is thinner near its distal end 70, and somewhat more thick near its proximal end 71. Making the petal thinner at the distal end causes the petal to become even more responsive to changes in pressure, and provides a valve that follows the changes in pressure even more rapidly. Notwithstanding the above, it is still possible, and within the scope of the present invention, to provide petals having thicknesses that do not vary.

Figure 12:
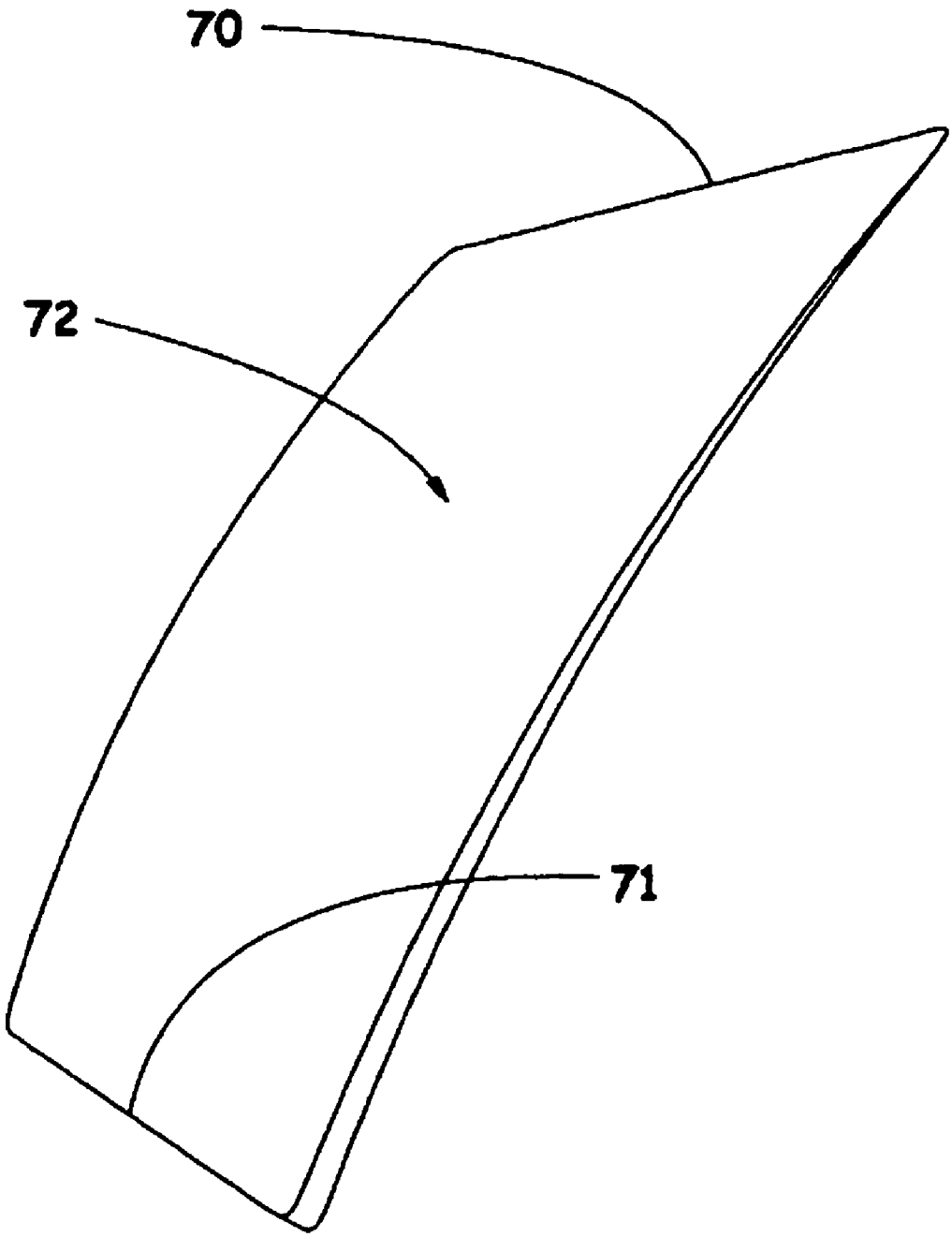
FIG. 12 provides a perspective view of a tapered petal used in the reed valve of the present invention.

FIG. 12 also illustrates, in a perspective view, the permanent curvature of the reed petal 72.

In the preferred embodiment, the petals of the reed valve are pre-stressed so that they tend to be biased in the closed position. In effect, the petals are naturally spring-loaded. The pre-stressing can be provided when the petals are made from a fibrous composite material. The pressure from the incoming fluid acts against the inherent spring force of the petals, causing the petals to open. The petals are preferably designed such that the spring force is proportional to the displacement of the petal from an equilibrium position.

It is also possible, within the scope of the invention, to make the petals without pre-stressing, and to provide instead a separate spring means which biases the petals in the closed position.

It is also possible to provide the petals with no spring-loading at all.

The invention can be modified in various ways. The amount of curvature of the petals can be varied. The materials used to make the petals, and the degree of pre-stressing, if any, can be changed. These and other modifications, which will be apparent to those skilled in the art, should be considered within the spirit and scope of the following claims.

What is claimed is:

1. In an internal combustion engine comprising a crankcase containing a cylinder, the crankcase also containing a piston disposed to reciprocate within the cylinder, and a reed valve positioned to supply a fluid from a region exterior to the crankcase to an interior region of the crankcase, the reed valve comprising a plurality of petals which open so as to allow fluid to flow into the crankcase, and which close so as to prevent fluid from flowing into or out of the crankcase, the improvement wherein the petals are curved, and wherein the petals are concave relative to fluid flowing through the reed valve and toward the crankcase.

2. The improvement of claim 1, wherein the petals are pre-stressed so as to be biased in a closed position.

3. The improvement of claim 1, wherein each petal has a permanent curvature.

4. The improvement of claim 1, wherein each petal has a distal tip, the distal tip being a location at which the petals nearly touch each other when the petals are closed, and wherein each petal has a reduced thickness in a vicinity of the distal tip.

5. The improvement of claim 1, wherein each petal is tapered so as to have a thickness which decreases continuously from a region of maximum thickness to a region of minimum thickness.

6. The improvement of claim 1, wherein the petals are mounted to a reed block which is attached to the crankcase.

7. A reed valve for an internal combustion engine, comprising a plurality of curved petals, each petal having a proximal end and a distal end, the proximal end of each petal being affixed to a housing, the distal end of each petal being free, the petals having a closed position wherein the distal ends of the petals are in proximity with each other, each petal being curved such that, when the petals are in the closed position, each petal defines a concave surface which faces another concave surface of another petal.

8. The reed valve of claim 7, wherein the petals are pre-stressed so as to be biased in the closed position.

9. The reed valve of claim 7, wherein each petal has a permanent curvature.

10. The reed valve of claim 7, wherein each petal has a reduced thickness in a vicinity of the distal end.

11. The reed valve of claim 7, wherein each petal is tapered so as to have a thickness which decreases continuously towards the distal end.

12. The reed valve of claim 7, wherein the housing comprises a generally hollow reed block having curved surfaces upon which the petals can rest when in the closed position.

13. A reed valve for an internal combustion engine, comprising a plurality of curved petals, each petal having a proximal end and a distal end, the proximal end of each petal being affixed to a housing, the distal end of each petal being free, the petals having a closed position wherein the distal ends of the petals are in proximity with each other, each petal being curved such that, when the petals are in the closed position, each petal defines a concave surface which faces another concave surface of another petal, wherein the petals are pre-stressed so as to be biased in the closed position, and wherein each petal has a permanent curvature.

14. The reed valve of claim 13, wherein each petal has a reduced thickness in a vicinity of the distal end.

15. The reed valve of claim 14, wherein each petal is tapered so as to have a thickness which decreases continuously towards the distal end.

16. The reed valve of claim 13, wherein the housing comprises a reed block which is attached to the crankcase.

* * * * *